US009812772B2

(12) United States Patent
Rojas Cuevas et al.

(10) Patent No.: US 9,812,772 B2
(45) Date of Patent: Nov. 7, 2017

(54) ANTENNA DEVICE AND AN ADAPTOR FOR AN ANTENNA DEVICE

(71) Applicant: Premo, S.L., Campanillas (Malaga) (ES)

(72) Inventors: Antonio Rojas Cuevas, Riogordo (ES); Francisco Ezequiel Navarro Perez, Malaga (ES); Maria Mar Villarrubia Garcia, Malaga (ES); Sergio Cobos Reyes, Malaga (ES); Claudio Canete Cabeza, Torremolinos (ES)

( * ) Notice: Subject to any disclaimer, the term of this patent is extended or adjusted under 35 U.S.C. 154(b) by 154 days.

(21) Appl. No.: 14/912,332

(22) PCT Filed: Dec. 20, 2013

(86) PCT No.: PCT/EP2013/003888
§ 371 (c)(1),
(2) Date: Feb. 16, 2016

(87) PCT Pub. No.: WO2015/022000
PCT Pub. Date: Feb. 19, 2015

(65) Prior Publication Data

US 2016/0211579 A1 Jul. 21, 2016

(30) Foreign Application Priority Data

Aug. 12, 2013 (ES) ..... 201331250

(51) Int. Cl.

| | |
|---|---|
| ***H01Q 1/50*** | (2006.01) |
| ***H01Q 7/08*** | (2006.01) |
| ***H01Q 1/12*** | (2006.01) |
| ***H01Q 7/06*** | (2006.01) |
| *H01Q 21/24* | (2006.01) |
| *H01Q 21/30* | (2006.01) |

(52) U.S. Cl.
CPC ..... *H01Q 1/50* (2013.01); *H01Q 1/12* (2013.01); *H01Q 7/06* (2013.01); *H01Q 7/08* (2013.01); *H01Q 21/24* (2013.01); *H01Q 21/30* (2013.01)

(58) Field of Classification Search
CPC .. H01Q 7/06; H01Q 7/08; H01Q 1/12; H01Q 1/50; H01Q 1/3241
See application file for complete search history.

(56) References Cited

U.S. PATENT DOCUMENTS

2011/0128204 A1* 6/2011 Murakami ..... H01Q 1/3241 343/788

* cited by examiner

*Primary Examiner* — Robert Karacsony
(74) *Attorney, Agent, or Firm* — Eugenio J. Torres-Oyola; Victor Rodriguez-Reyes; Ferraiuoli LLC

(57) ABSTRACT

The antenna device comprises:
a magnetic core;
one or more windings (W1) wound around the magnetic core;
an electrically insulating base (1), on which the magnetic core wound with the one or more windings (W1) is arranged, and which comprises electrically conductive elements (11, 12, 13), which are electrically connected to the one or more one windings (W1); and
an adaptor (A) is arranged over the magnetic core and comprising an electrically insulating piece (140) having an upper surface comprising electrically conductive platings (121, 122, 123) following a specific PCB layout and at least part of which are connected to the electrically conductive elements (11, 12, 13) of the electrically insulating base (1).
The adaptor is suitable for its use as the adaptor of the antenna device of the present invention.

15 Claims, 10 Drawing Sheets

ANTENNA DEVICE AND AN ADAPTOR FOR AN ANTENNA DEVICE

FIELD OF THE ART

The present invention generally relates, in a first aspect, to an antenna device having conductive platings following a first printed circuit board layout designed for its connection to respective conductive tracks of a first printed circuit, and more particularly to an antenna device comprising an adaptor having conductive platings following a second printed circuit board layout designed for its connection to respective conductive tracks of a second printed circuit, different to the first printed circuit.

A second aspect of the invention concerns to an adaptor for an antenna device configured as the adaptor of the antenna device of the first aspect of the invention.

PRIOR STATE OF THE ART

There are several antenna devices in the state of the art which comprise one or more windings wound around one or more magnetic cores mounted over an electrically insulating base, the latter having, across its lower surface, electrically conductive platings for its connection to respective points of conductive tracks of a circuit printed in a PCB (Printed Circuit Board).

One of said antenna devices is disclosed in Chinese utility model CN201789061U, which relates to an enhanced 3D antenna applied to a keyless entering system, which comprises a three-axis winding wound on a rectangular magnetic core, wherein the three-axis winding comprises three mutually-orthogonal windings; and the rectangular magnetic core is fixed on a base having side projecting metallic elements to which ends of the three windings are connected.

The antenna device disclosed in said Chinese utility model and all the antenna devices known by the present inventors have their bases specifically designed for their connection to a particular PCB, i.e. the electrically conductive platings arranged at their bases are designed to coincide with specific points of tracks of a printed circuit, in order to be welded/soldered there to when arranged thereon.

Therefore, either the antenna device is designed for a particular PCB design or vice versa, making said known antenna devices useless for a different PCB which is not known a priori when manufacturing the base thereof, and hence having an inherent lack of flexibility in their use, which constitutes an objective technical problem.

On the other hand, different adaptors for antenna devices are known, some of them disclosed in patent documents, the adapting they perform being related to different purposes, mainly for mechanically adapting the antenna device to another element, such as the adaptor disclosed by EP2110884B1, which mechanically adapts an electromagnetic aperture of a reflector frame of a surface-mountable antenna device to accommodate a waveguide of testing or tuning equipment

DESCRIPTION OF THE INVENTION

It is an object of the present invention to provide an alternative to the prior state of the art, which solves the above mentioned objective technical problem, providing an antenna device with the flexibility in its use which the prior art antenna devices don't have, making it usable for at least one PCB layout which doesn't need to be known during the manufacturing of the base thereof.

To that end, the present invention relates, in a first aspect, to an antenna device comprising:

- at least one magnetic core;
- at least one winding wound around said at least one magnetic core;
- an electrically insulating base, on which said at least one magnetic core wound with said at least one winding is arranged, and which comprises electrically conductive elements (preferably one per winding), such as a metallic element, at least part of which are electrically connected to said at least one winding; and
- an adaptor.

Contrary to the prior art antenna devices, in the one of the first aspect of the present invention said adaptor is arranged over said at least one magnetic core and comprises an electrically insulating piece having an upper surface comprising electrically conductive platings following a specific printed circuit board layout (that can be any layout) and at least part of which are connected to the electrically conductive elements of the electrically insulating base.

By the provision of the electrically conductive platings on said adaptor, the electrically insulating base can be manufactured before knowing to which PCB layout the antenna device is intended to be connected, and thereafter, once said PCB layout is known, the electrically conductive platings are provided to the upper surface of the electrically insulating piece constituting the adaptor with the printed circuit board layout suitable for their connection to said PCB layout. Thereafter, the adaptor is attached to the electrically insulating base and, thus, the antenna device is then already designed for its connection to said PCB layout.

Hence, a plurality of generic electrically insulating bases can be manufactured beforehand, and then groups thereof can be adapted for respective and different PCB layouts by the manufacturing and attaching thereto of corresponding groups of adaptors having different printed circuit board layouts for their electrically conductive platings, each for a specific PCB layout, thus achieving the above mentioned flexibility in the use of the antenna device.

For an embodiment, said electrically insulating base has an upper surface and a lower surface, wherein said lower surface comprises electrically conductive platings which are electrically connected or integral to said electrically conductive elements of the electrically insulating base, and follow a printed circuit board layout which is different to said specific printed circuit board layout followed by the electrically conductive platings of the electrically insulating piece of the adaptor. Therefore, such an antenna device has an even higher increase in its flexibility of use, as can be alternately connected to two different PCB layouts.

For an embodiment, part or all of said electrically conductive platings following said specific printed circuit board layout extend through side surfaces of the electrically insulating piece of the adaptor constituting side extended portions thereof.

Preferably, said electrically conductive elements project outwardly (as wrapping pins) from one or more sides of the electrically insulating base and will be the connection base for the wrapping ends of each winding. Said outwardly projecting conductive elements make electrical contact with a free end of one or more of the side extended portions of the electrically conductive platings of the electrically insulating piece of the adaptor.

Other alternative variants of said embodiment cover different configurations and arrangements for said electrically conductive elements and/or for the free ends of said side extended portions which allow the mentioned electrical contact there between, such as a variant for which the electrically conductive elements remain inside respective recesses or holes defined in the base sides and the free ends of the side extended portions are configured such that they enter into said recesses and contact the electrically conductive elements.

The person skilled in the art would find any other alternative variants without using his inventive skills.

Preferably, at least part of the electrically conductive elements are connected to the one or more windings, preferably by welding/soldering, and more preferably by welding/soldering a twisted end of the winding to the electrically conductive element, in order to increase the cross section of the to be welded/soldered winding end in the joint area between the winding and the electrically conductive element. This twisting provides, mainly, increasing the robustness of the connection as it avoid a winding breaking due, for instance, to a possible overheating caused by the welding/soldering or to mechanical forces exerted by other machines used in the manufacturing process of the antenna device.

For a preferred embodiment, the adaptor is, via its electrically insulating piece, fixedly attached to the electrically insulating base, for example by gluing.

According to an embodiment, the at least one magnetic core is a monolithic magnetic core, the antenna device constituting a monolithic antenna device.

The at least one magnetic core is, for an embodiment, a soft magnetic core, formed for example of Manganese Zinc Ferric Oxide ferrite, Nickel Zinc Ferric Oxide ferrite or any metallic alloy of Nickel or Manganese Zinc, and/or amorphous Cobalt and or nanocrystalline Cobalt.

For an embodiment, the antenna device of the firs aspect of the invention comprises three windings wound around three mutually orthogonal axes, where each of said three windings surrounds said at least one magnetic core.

According to an embodiment, said electrically insulating piece of the adaptor constitutes a cover with an upper wall having said upper surface onto which the electrically conductive platings of the electrically insulating piece of the adaptor are arranged, and at least two side walls on the outer surfaces thereof said side electrically conductive platings are arranged, said cover being arranged covering said at least one magnetic core and said at least one winding.

A second aspect of the invention concerns to an adaptor for an antenna device, wherein said antenna device comprises:

- at least one magnetic core;
- at least one winding wound around said at least one magnetic core; and
- an electrically insulating base, on which said at least one magnetic core wound with said at least one winding is arranged, and which comprises electrically conductive elements, at least part of which are electrically connected to said at least one winding.

Contrary to the prior art cited adaptors, the one of the second aspect of the invention is configured for being arranged over said at least one magnetic core and attached to the antenna device, and comprises an electrically insulating piece having an upper surface comprising electrically conductive platings following a specific PCB layout and at least part of which are configured and arranged to be connected to the electrically conductive elements of the electrically insulating base.

For an embodiment, the adaptor is configured for being attached to an antenna device with an electrically insulating base which has an upper surface and a lower surface, wherein said lower surface comprises electrically conductive platings which are electrically connected or integral to said electrically conductive elements of the electrically insulating base and follow a PCB layout, wherein the specific PCB layout of the electrically conductive platings of the electrically insulating piece of the adaptor is different to said PCB layout of the electrically conductive elements of the electrically insulating base.

For a preferred embodiment, the adaptor of the second aspect of the invention is configured as the adaptor of the antenna device of the first aspect.

BRIEF DESCRIPTION OF THE DRAWINGS

The previous and other advantages and features will be better understood from the following detailed description of embodiments, with reference to the attached drawings, which must be considered in an illustrative and non-limiting manner, in which.

DETAILED DESCRIPTION OF SEVERAL EMBODIMENTS

Figure 1:
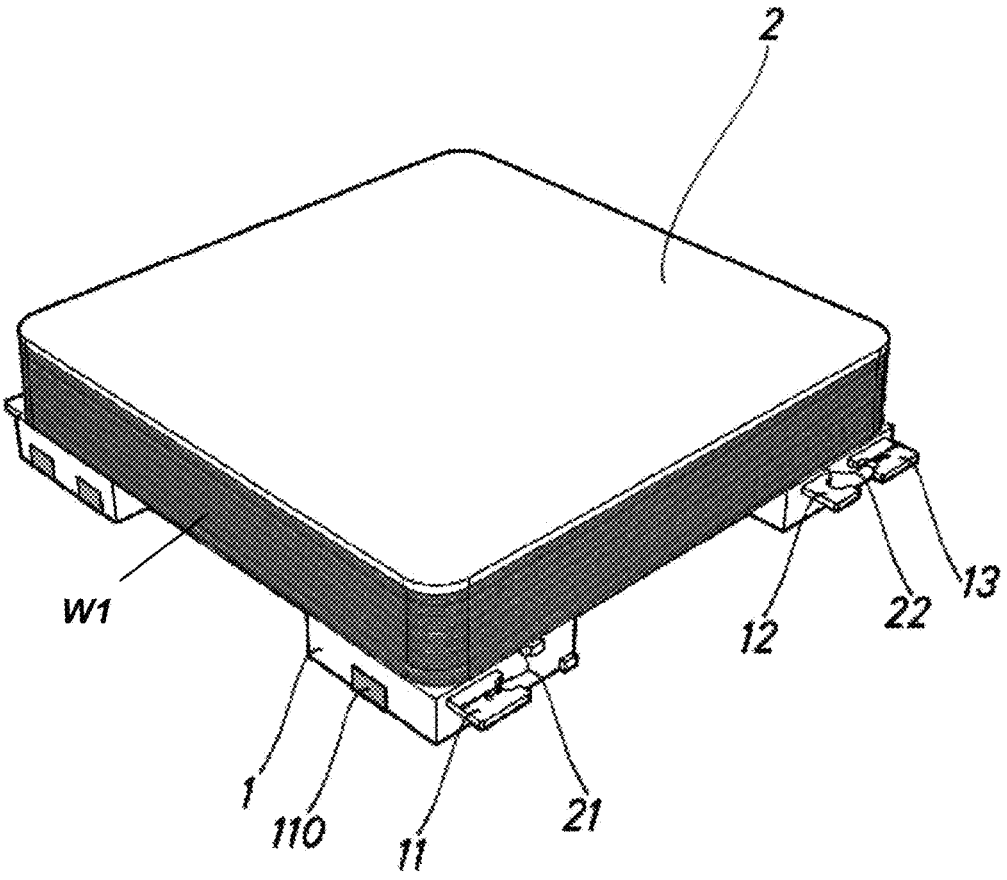
FIG. 1 is a perspective view which shows part of the elements of the antenna device of the first aspect of the invention, for an embodiment.

FIG. 1 shows part of the antenna device of the first aspect of the invention, which, although only one winding W1 is shown, preferably comprises several windings wound around a ferrite core (not shown) attached to the electrically insulating base 1, such as made of plastics.

For a preferred embodiment, the present invention is particularly applicable to three-axis antennas, i.e. those that comprise three windings wound around the core orthogonally to each other, for other embodiment the present invention is applicable to any number and arrangement of windings and of magnetic cores.

Figure 3:
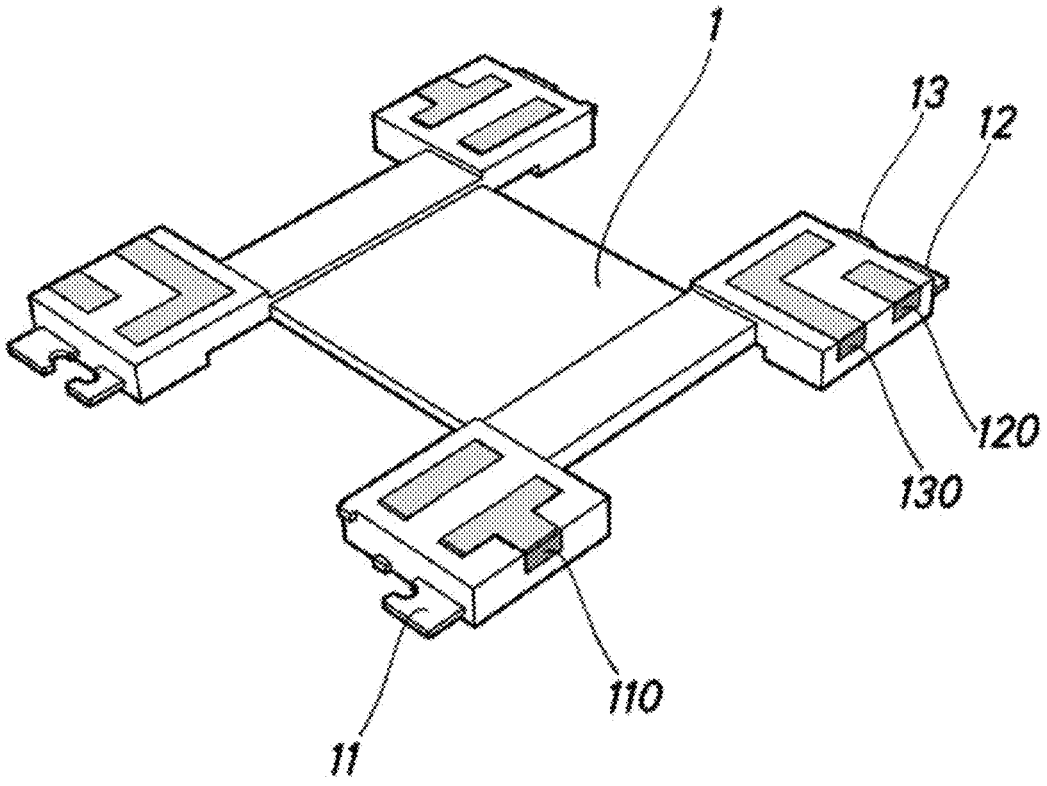
FIG. 3 shows the same electrically insulating base shown in FIG. 2, but by means of a perspective view taken from below.
Figure 8A:
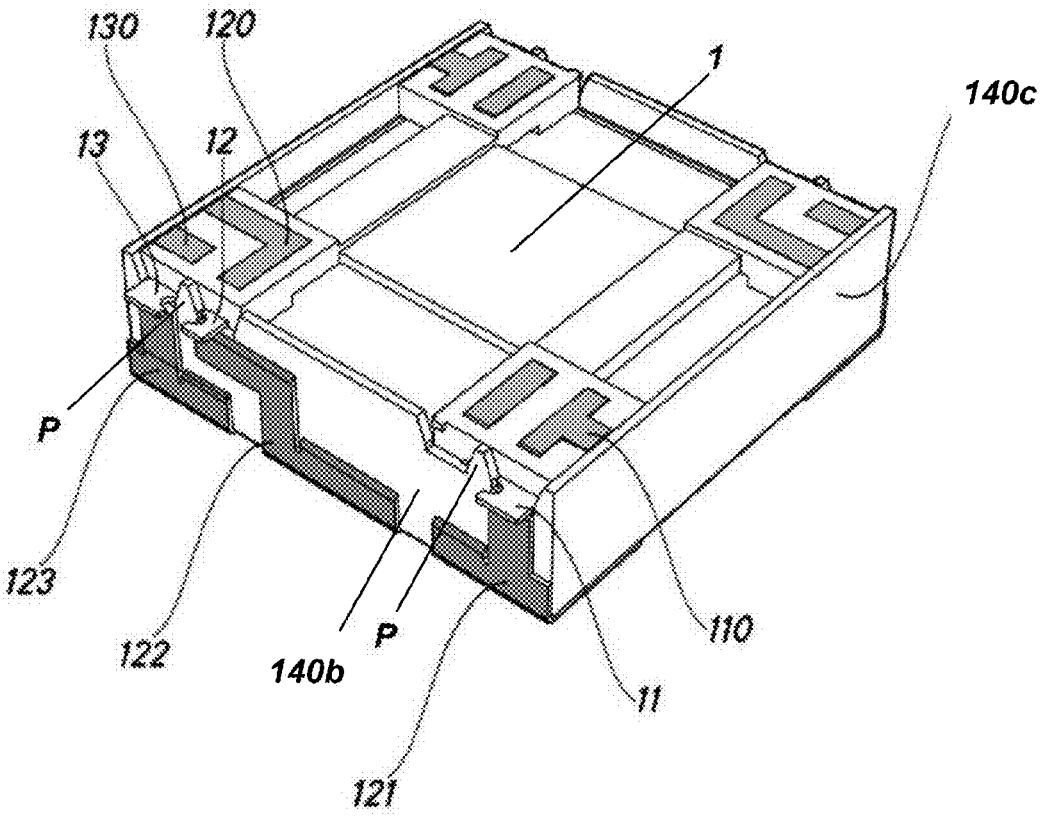
FIG. 8*a* shows, by means of a perspective view from below, the antenna device of the first aspect of the invention, for the embodiments of FIGS. 1 to 6, once the adaptor of FIG. 7 is attached to the electrically insulating base covering the winding(s) and magnetic core(s)

For the embodiment shown in FIGS. 3 and 8*a*, the base 1 comprises, at its lower surface, electrically conductive platings 110, 120, 130 which extend through the sides of the base 1.

The portions of the electrically conductive platings 110, 120, 130 placed at the lower surface of the base 1 are intended for the electrical connection of the antenna device to a specific circuit, defined for example in a PCB, via the welding/soldering of said portions to different points of the tracks of said specific circuit.

On the other hand, the portions of the electrically conductive platings 110, 120, 130 placed at the sides of the base 1 are intended to, when the antenna device is incorporated to another system, allow the electrical connections be visible not only from the lower part of the base 1 but also from the sides of the base 1, in order to allow an Automatized Optical Inspection (AOI) be performed to determine if a correct welding/soldering has been effected.

Figure 8B:
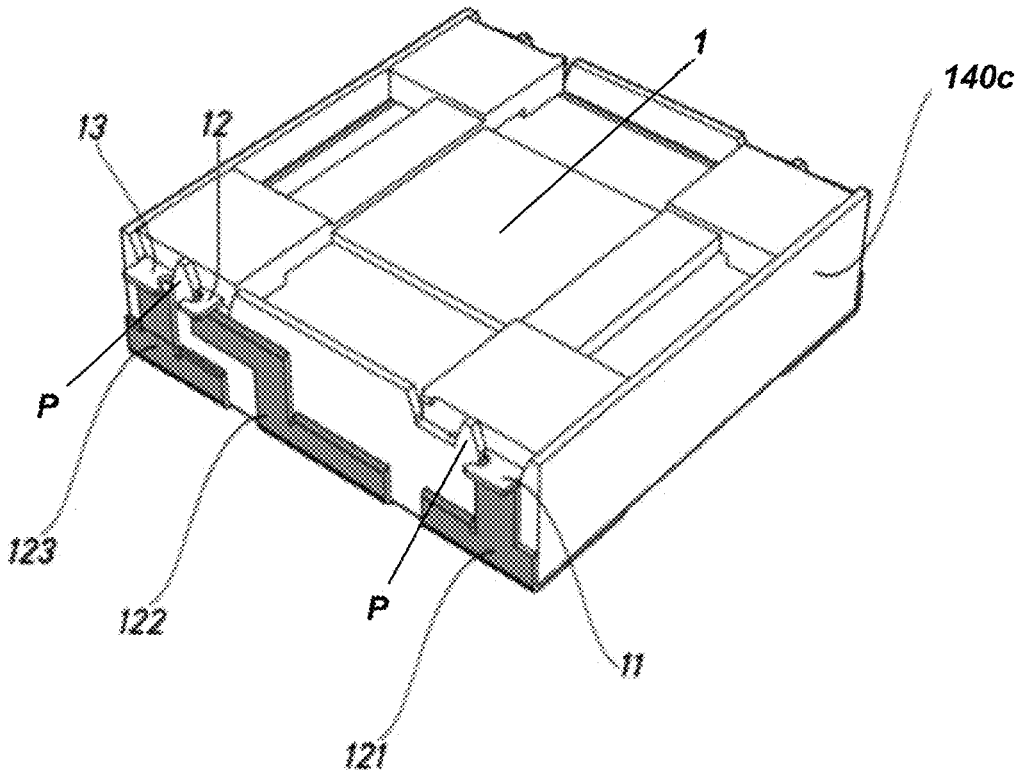
FIG. 8*b* differs to FIG. 8*a* only in that the electrically conductive base has no electrically conductive platings defined at its lower surface.

For the embodiment of FIG. 8*b*, the base 1 does not have electrically conductive platings at all.

Moreover, as shown in FIG. 1, the antenna device comprises projecting electrically conductive elements 11, 12, 13 (metallic elements) to which the ends 21, 22 of the windings are connected.

In FIG. 1, only winding W1 is shown, the rest of windings and magnetic core remaining under label 2 placed on winding W1. Label 2 should be a foam label to absorb mechanical impacts over the piece when is assembled in the proper PCB.

Figure 2:
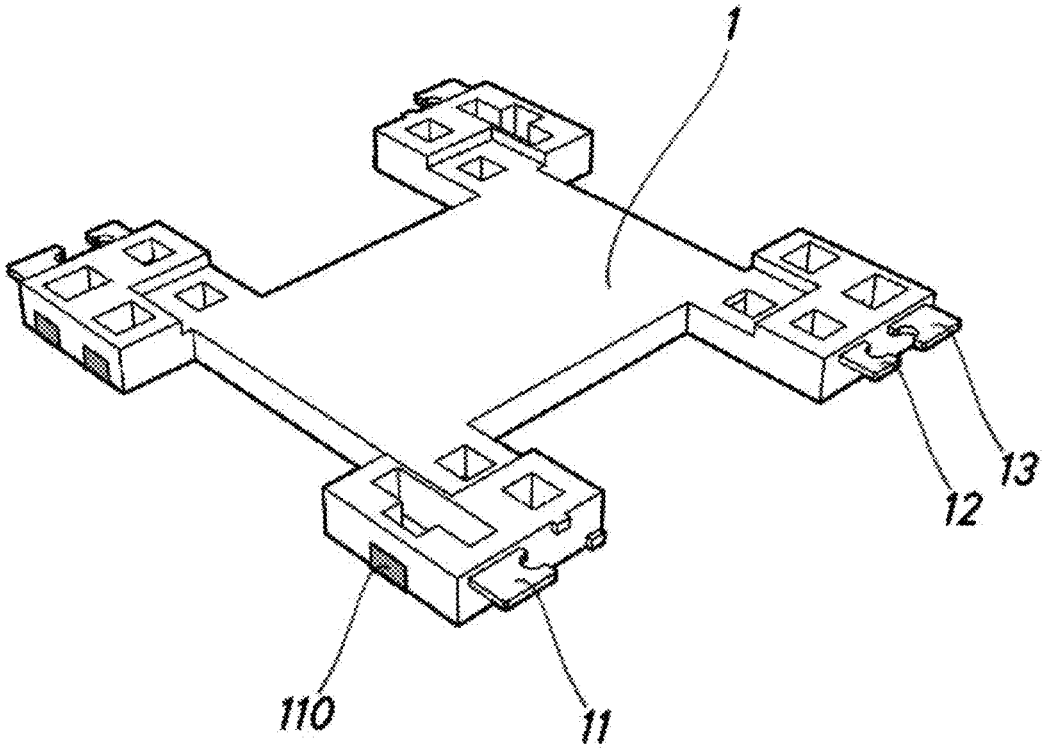
FIG. 2 shows, by means of a perspective view from above, the electrically insulating base of the antenna device of the first aspect of the invention, for an embodiment.
Figure 7:
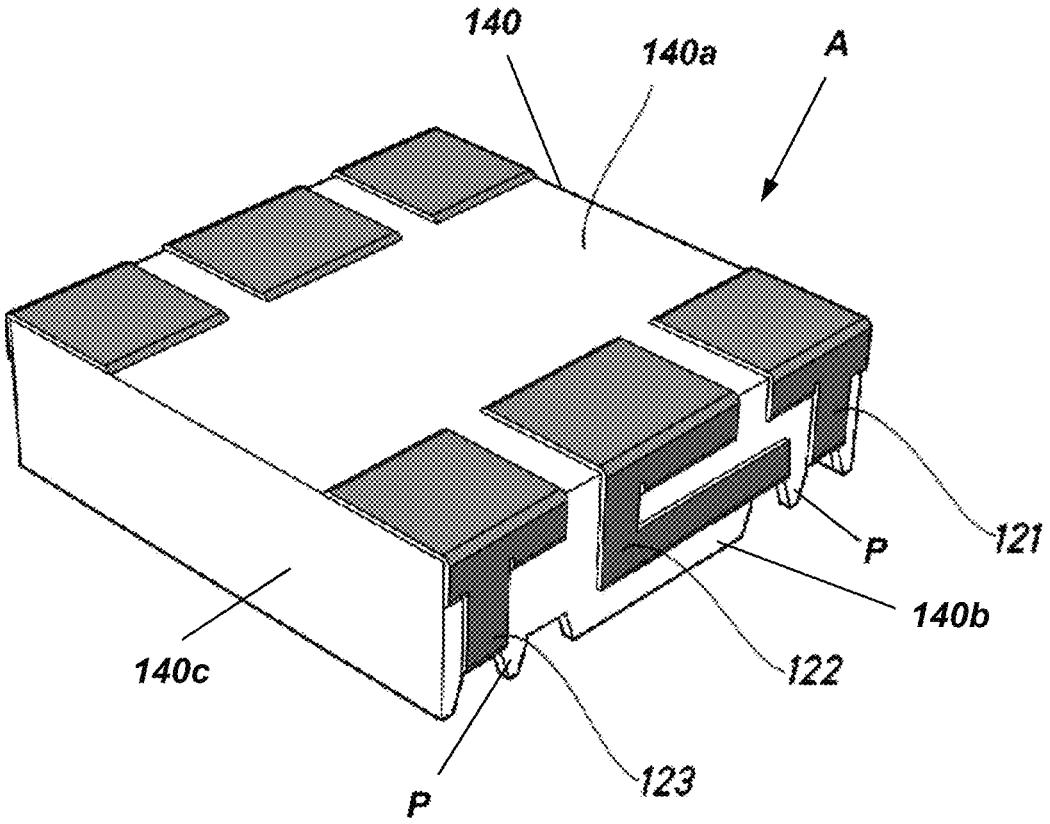
FIG. 7 shows, by means of a perspective view from above, the adaptor of the second aspect of the invention and of the antenna device of the first aspect of the invention, for an embodiment.
Figure 9:
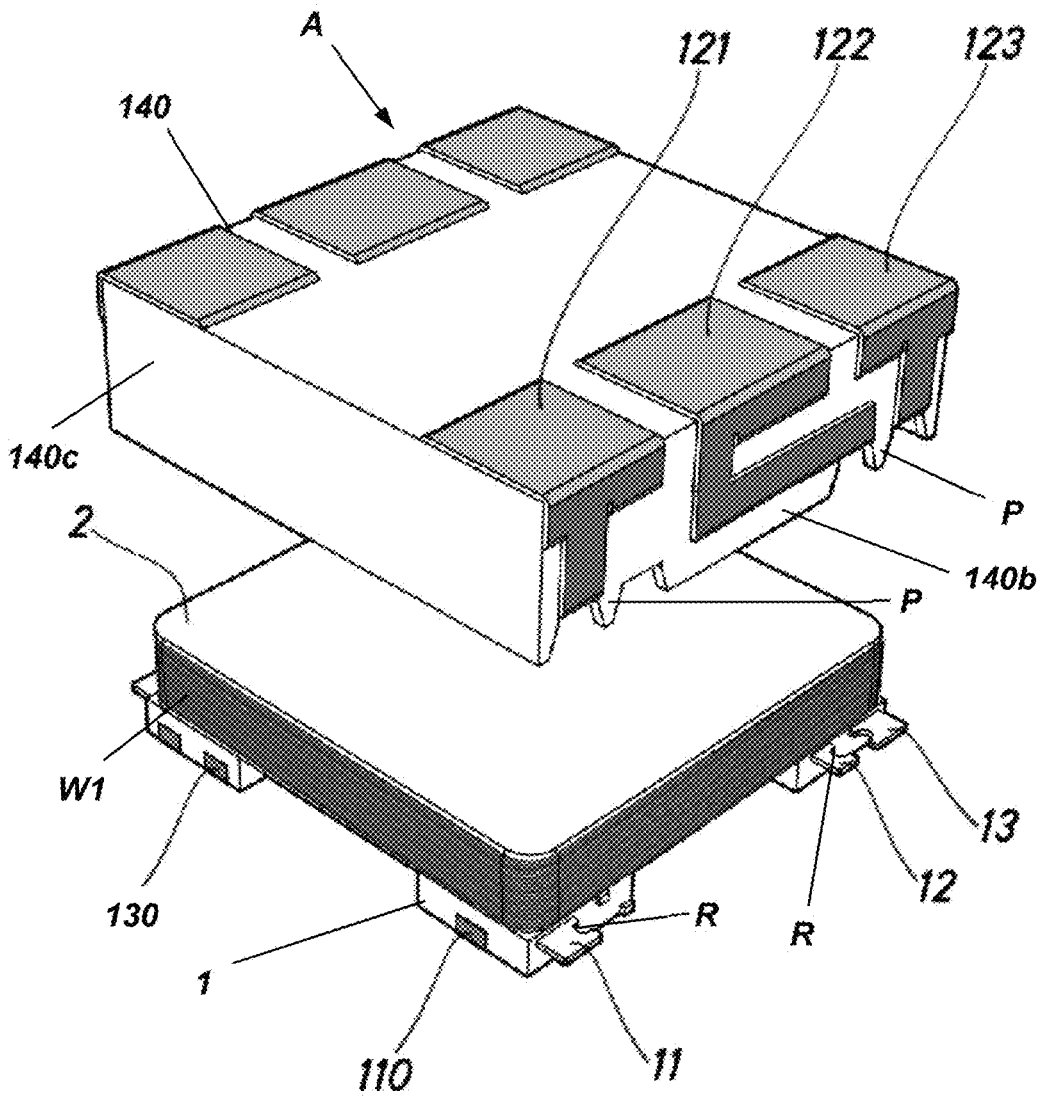
FIG. 9 is an exploded perspective view from above, which shows the same elements of FIG. 8*a* before the adaptor is attached to the electrically insulating base of the antenna device of the first aspect of the invention.

FIGS. 2 and 3 illustrate the electrically insulating base 1 of the antenna device, showing in detail the projecting electrically conductive elements 11, 12, 13 for the connection of the ends 21, 22 of the windings, and also for the connection of the metallic platings 121, 12, 123 of the adaptor A (see FIGS. 7 and 9).

For the embodiment of FIG. 8*a*, these electrically conductive elements 11, 12, 13 are electrically connected to the metallic platings 110, 120, 130 of the base 1 so that connections to the windings are available both in the sides of the base 1 (for performing the AOI) and in the lower face of the base 1, for their electrical connection to a first PCB. In this manner, one can check, by means of an AOI system, on one hand, if the windings are correctly welded/soldered to the projecting electrically conductive elements, and on another hand, if the platings 110, 120, 130 are correctly welded/soldered to pins or to any other electrical connection means.

FIG. 3 clearly show how the platings 110, 120, 130 are distributed along different areas of the lower face of the base 1 (at its four corners) and extend to the sides of the base 1, and how each of the projecting electrically conductive elements 11, 12, 13 corresponds to a respective plating 110, 120, 130 of the lower and side faces of the base 1. Thus, projecting electrically conductive elements 11, 12 and 13 correspond, respectively, to metallic platings 110, 120 and 130, and there can be arranged as many platings and projecting electrically conductive elements as winding ends the antenna device comprises. Particularly, a three-axis antenna device comprising three windings arranged orthogonally to each other would have six projecting electrically conductive elements with their corresponding platings. For other embodiments (not shown) of the antenna device of the present invention, a high frequency winding is included that would correspond to a fourth winding. In this case, base 1 would have eight projecting electrically conductive elements with their corresponding platings.

Figure 4:
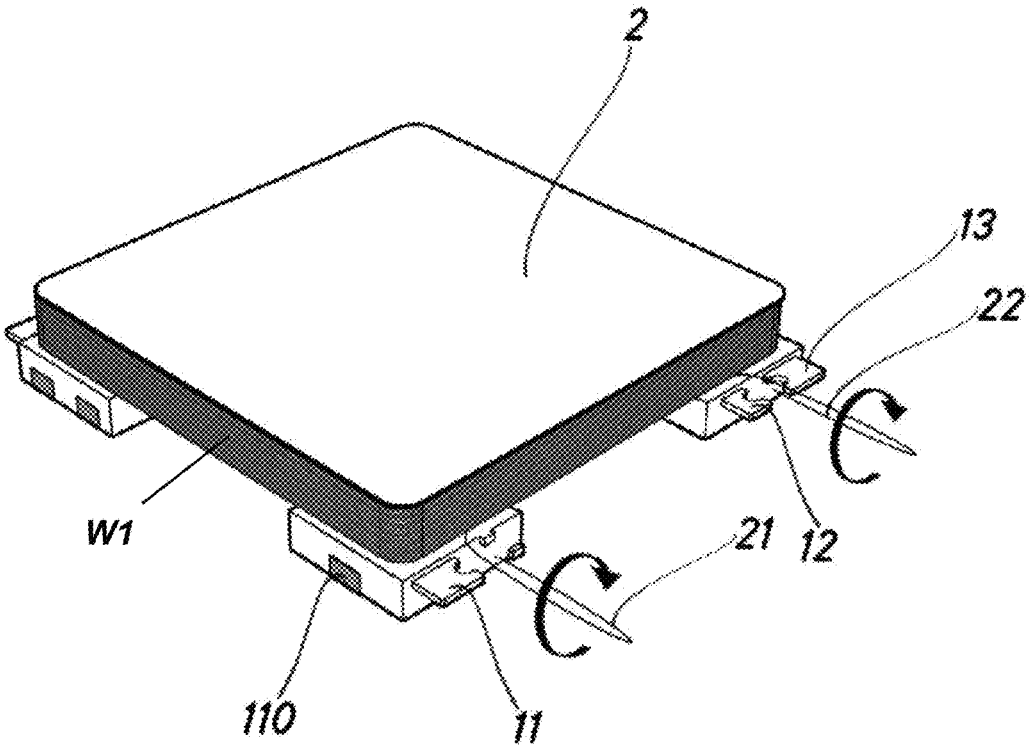
FIG. 4 shows, also by means of a perspective view, an example of how the winding ends are twisted before its connection to the electrically conductive elements projecting from the sides of the electrically insulating base of the antenna device of the first aspect of the invention, for an embodiment.

FIG. 4 shows a preferred mode for connecting the winding ends 21, 22 to the projecting electrically conductive elements 11, 12. It should be highlighted that the windings used for this kind of applications have an approximate diameter of between 0.01 mm and 1 mm, so they are electric conductors very fragile to some physical conditions, such as those mechanical forces caused due to the automatic means used for their arranging over the magnetic core or the heat generated by their welding/soldering to the projecting electrically conductive elements 11, 12, 13, among others.

Figure 5:
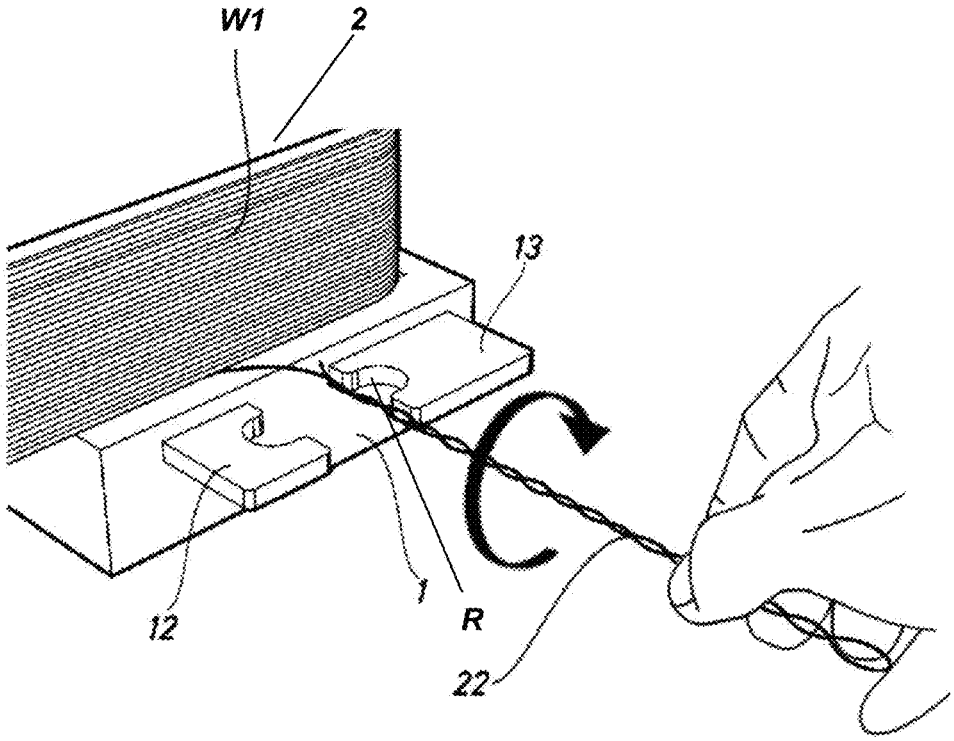
FIG. 5 shows, by means of a zoomed view, of the connection example of FIG. 4, once the shown winding end is already twisted.

To cope with that problem, in the antenna device of the present invention the winding ends are bended over (as shown in FIG. 4) so that their volume is increased (particularly their cross section) to increase their resistance and, subsequently, they are twisted (as shown in FIG. 5) to obtain a higher robustness.

FIGS. 4 and 5 show in detail the mentioned bending and twisting of the winding ends. In this case, as shown in FIG. 5, the end 22 of winding W1 can be connected to any of the projecting electrically conductive elements 12, 13.

Figure 6:
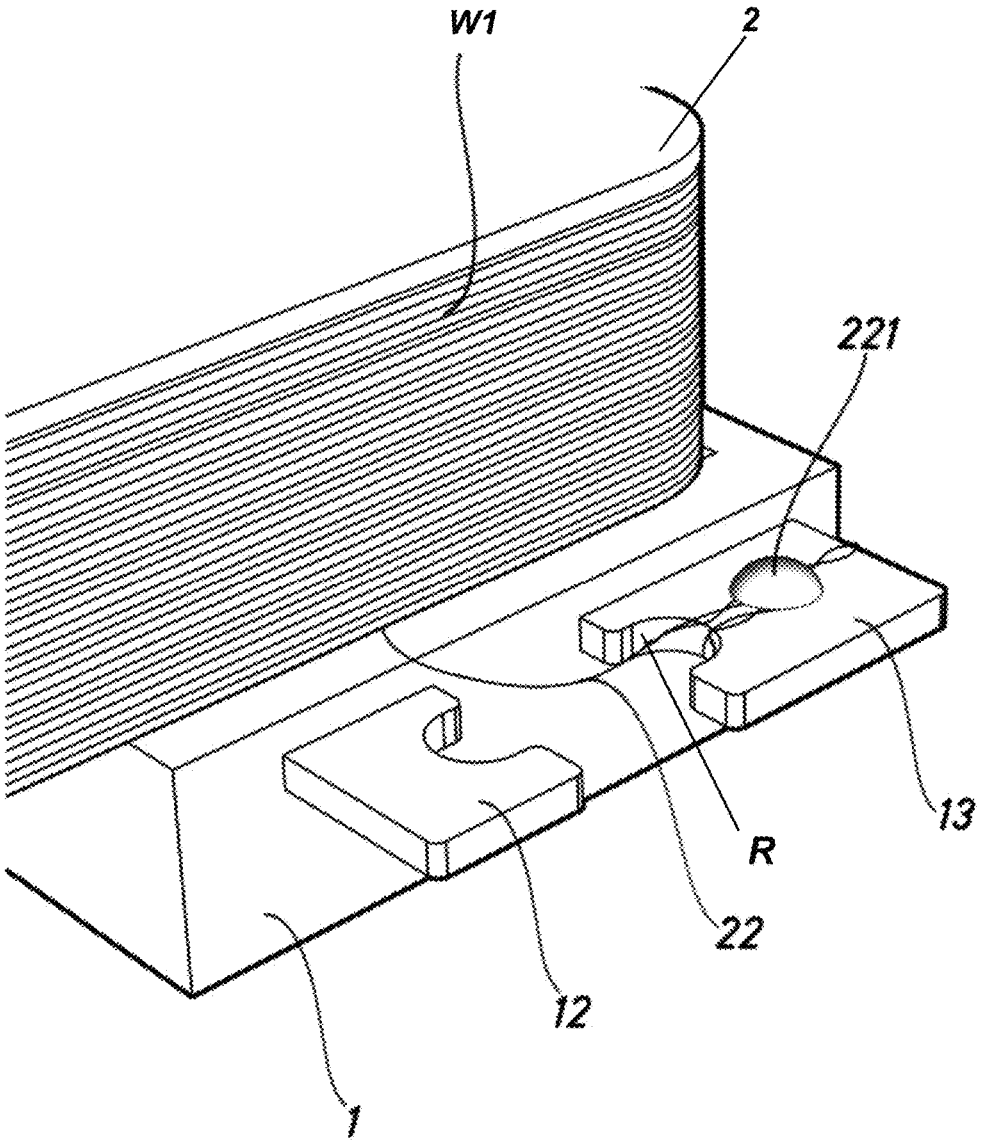
FIG. 6 shows the same elements of FIG. 5, but once the twisted winding end has been welded/soldered to the projecting metallic element.

FIG. 6 also shows how the projecting electrically conductive element 13 comprises a recess R which prevents the winding end 22, once coiled, may slide and fall off the projecting electrically conductive element 13. Each of the rest of projecting electrically conductive elements also comprises such a recess.

As shown in FIG. 6, the connection of the winding end 22 to the projecting electrically conductive element 13 is performed simply by wrapping the winding end 22 around the projecting electrically conductive element 13 and by, subsequently, applying a welding/soldering joint 221, although, preferably, the welding/soldering is not applied only as one spot (as shown in FIG. 6) but covering part or the entire projecting electrically conductive element 13, to assure a proper robustness for the joint and electrical connection.

For an embodiment, said welding/soldered joint 221 is obtained by a Tin soldering widely known in the art, and the projecting electrically conductive elements 11, 12, 13 are made with Sn100 Tin to make easy a later soldering.

FIGS. 7 and 9 shows the adaptor A of the second aspect of the invention and which is included in the antenna device of the first aspect of the invention, which purpose is to increase the flexibility of possible connections of an antenna device, in order to make it suitable for its connection to:

- a further PCB with a tracks layout different to the one of the PCB to which the antenna device without the adaptor A is initially designed for, according to the embodiment of FIGS. 3 and 8*a*, i.e. for a base 1 already having electrically conductive platings 110, 120, 130 on its lower surface, following a layout adapted to a PCB layout; or
- a PCB with a tracks layout which is not known a priori when manufacturing the base 1, for the embodiment of FIG. 8*b* where the base 1 has no electrically conductive platings at all.

This adaptor A provides such a flexibility by including, as shown in FIGS. 7 and 9, an electrically insulating piece 140 with an upper surface onto which electrically conductive platings 121, 122, 123 following a specific PCB layout that permits the electrical connection of the electrically conductive elements 11, 12, 13 to the PCB layout of a PCB, being said specific layout, for the embodiment of FIGS. 3 and 8*a*, different to the PCB layout followed by the base platings 110, 120, 130, for their connection to respective points of the tracks of a printed circuit different to the one to which platings 110, 120, 130 are designed for.

This adaptor A can be configured according to any user PCB arrangement, i.e. to any printed circuit arrangement, by designing and disposing the platings 121, 122, 123 on purpose for said printed circuit arrangement, with the proper PCB layout, and mechanically attaching the adaptor A to the base 1 of the antenna device, thus providing an antenna device suitable for its connection to:

for the embodiment of FIGS. 3 and 8*a*: two different PCB layouts, one at the lower face of the base 1 and another at the upper face of an upper wall 140*a* of the piece 140 of the adaptor A; hence, the user can choose which platings layout wants to use with its PCB; or for the embodiment of FIG. 8*b*: only one PCB, but which can have any PCB layout not known a priori when manufacturing the base 1.

For the illustrated embodiment, the piece 140 of the adaptor A constitutes a cover with the above mentioned upper wall 140*a* having said upper surface onto which the electrically conductive platings 121, 122, 123 are arranged, and four side walls, two of them 140*b*, 140*c* can be seen in FIGS. 7, 8*a*, 8*b* and 9, on the outer surfaces thereof platings 121, 122, 123 are arranged, said cover being arranged covering the magnetic core and the windings, when coupled to the base as shown in FIGS. 8*a* and 8*b*.

Platings 121, 122, 123 are electrically connected to the windings of the antenna device by their electrical connection to the projecting electrically conductive elements 11, 12, 13, and mechanically connected to the base 1 and/or to the magnetic core (not shown).

FIGS. 8*a*, 8*b* and 9 show said electrical and mechanical connection of the adapter A, for an embodiment. The mechanical attachment is preferably performed by adhesive, although for other embodiments (not shown) both the adapter A and the base 1 have specific mechanical coupling means, such as pins in the adapter A to be inserted in respective holes of the base 1, or vice versa, or conjugated pieces which, by pressing, attach to each other.

For the embodiment illustrated in FIGS. 7, 8*a*, 8*b* and 9, each of two opposite side walls of piece 140, particularly side wall 140*b* and the one opposite thereto (not shown), has a lower edge with indentations defining prongs P which enter recesses R of projecting electrically conductive elements 11, 12 to provide an initial mechanical coupling which is, preferably, increased by, for instance, gluing.

As shown in FIGS. 7, 8*a*, 8*b* and 9, platings 121, 122, 123 extend through side wall 140*b* of piece 140 (and although not shown, also through side wall opposite to side wall 140*b*) constituting side extended portions thereof with free ends placed at the lower edge of the side wall 140*b*, adjacent to prongs P, such that when the piece 140 is attached to the base 1 (as shown in FIGS. 8*a* and 8*b*) said free ends press, and thus make electrical contact, with the projecting electrically conductive elements 11, 12 and 13, providing the above mentioned electrical connection of the platings 121, 122, 123 to the windings of the antenna device, as the ends of the windings are welded/soldered to the projecting electrically conductive elements 11, 12, 13.

To sum up, with the proposed adapter A, it is obtained an antenna device having at least one electrical configuration defined at the upper face of the adapter A to use with his PCB (for the embodiment of FIG. 8*b*), this configuration susceptible to be visually inspected by AOI systems.

For the embodiment of FIGS. 3 and 8*a*, the obtained antenna device has a first electrical configuration defined at its base 1 and a second electrical configuration defined at the upper face of the adapter A, so the user can choose between said two configurations to use with his PCB, both of said configurations being susceptible to be visually inspected by AOI systems. To avoid shortcuts or inadequate connections, once the user has selected the desired electrical configuration, he can provide any kind of electrical insulator over the face including the plating he is not going to use, for example by means of adhesives or partial over mouldings.

As for the materials used for building the antenna device, the magnetic core is usually madea by a soft magnetic core, formed for example of Manganese Zinc Ferric Oxide ferrite, Nickel Zinc Ferric Oxide ferrite or any metallic alloy of Nickel or Manganese Zinc, and/or amorphous Cobalt and or nanocrystalline Cobalt.

The windings are, preferably, of a diameter of between 0.01 mm and 1 mm and can be made with cables enamelled with polyurethane and (or polyamide with a heat index of about 150° C. or higher.

A person skilled in the art could introduce changes and modifications in the embodiments described without departing from the scope of the invention as it is defined in the attached claims.

The invention claimed is:

1. An antenna device, comprising:

at least one magnetic core;

at least one winding (W1) wound around said at least one magnetic core;

an electrically insulating base (1), on which said at least one magnetic core wound with said at least one winding (W1) is arranged, and which comprises electrically conductive elements (11, 12, 13), arranged according to a first layout at least part of which are electrically connected to said at least one winding (W1);

an adaptor;

the antenna device being characterised in that said adaptor (A) is arranged over said at least one magnetic core and comprises an electrically insulating piece (140) having an upper surface and a side surface, the adaptor (A) comprising electrically conductive platings (121, 122, 123) each having a first portion arranged on said upper surface following a second layout, and a second extended portion arranged on said side surface following said first layout in that the adaptor (A), together with its electrically conductive platings (121, 122, 123), and the electrically insulated base (1), together with its electrically conductive elements (11, 12, 13), are separate elements attached to each other such that the second extended portions of the electrically conductive platings (121, 122, 123) are connected to the electrically conductive elements (11, 12, 13) of the electrically insulating base (1).

2. The antenna device of claim 1, wherein said electrically insulating base (1) has an upper surface and a lower surface, wherein said lower surface comprises electrically conductive platings (110, 120, 130) which are electrically connected or integral to said electrically conductive elements (11, 12, 13) of the electrically insulating base (1), and follow a third layout which is different to said second layout followed by the electrically conductive platings (121, 122, 123) of the electrically insulating piece (140) of the adaptor (A).

3. The antenna device of claim 2, wherein at least part of said electrically conductive platings (121, 122, 123) following said second layout extend through side surfaces of the electrically insulating piece (140) of the adaptor (A) constituting side extended portions thereof.

4. The antenna device of claim 3, wherein said electrically conductive elements (11, 12, 13) project outwardly from at least one side of said base (1) such that they make electrical contact with a free end of at least one of said side extended portions of the electrically conductive platings (121, 122, 123) of the electrically insulating piece (140) of the adaptor (A).

5. The antenna device of claim 4, wherein at least one of the electrically conductive elements (11, 12, 13) is connected to the at least one winding (W1) by welding or soldering a twisted end (21, 22) thereof to the electrically conductive element (11, 12, 13).

6. The antenna device of claim 2, wherein said electrically insulating base (1) comprises at least one of said electrically conductive elements (11, 12, 13) per winding end (21, 22).

7. The antenna device of claim 2, wherein said adaptor (A) is, via its electrically insulating piece (140), fixedly attached to said electrically insulating base (1).

8. The antenna device of claim 1 wherein said at least one magnetic core is a monolithic magnetic core, the antenna device constituting a monolithic antenna device.

9. The antenna device of claim 8, wherein said at least one magnetic core is a ferrite magnetic core.

10. The antenna device of claim 9, wherein said ferrite magnetic core is formed with a Nickel-Zinc alloy or a Manganese-Zinc alloy and/or amorphous cobalt and/or nanocrystalline cobalt.

11. The antenna device of claim 2, comprising three windings wound around three mutually orthogonal axes, where each of said windings surrounds said at least one magnetic core.

12. The antenna device of claim 3, wherein said electrically insulating piece (140) of the adaptor (A) constitutes a cover with an upper wall (140a) having said upper surface onto which first portion of the electrically conductive platings (121, 122, 123) of the electrically insulating piece (140) of the adaptor (A) are arranged, and at least two side walls (140b, 140c) on the outer surfaces thereof onto which said second portion of said side electrically conductive platings (121, 122, 123) are arranged, said cover being arranged covering said at least one magnetic core and said at least one winding (W1).

13. The antenna device of claim 1, wherein at least part of said electrically conductive platings (121, 122, 123) following said second layout extend through side surfaces of the electrically insulating piece (140) of the adaptor (A) constituting side extended portions thereof.

14. An adaptor (A) for an antenna device, wherein said antenna device comprises:

at least one magnetic core;

at least one winding (W1) wound around said at least one magnetic core; and an electrically insulating base (1), on which said at least one magnetic core wound with said at least one winding (W1) is arranged, and which comprises electrically conductive elements (11, 12, 13), arranged according to a first layout at least part of which are electrically connected to said at least one winding (W1);

the adaptor (A) being characterised in that it is configured for being arranged over said at least one magnetic core and attached to the antenna device, and in that it comprises an electrically insulating piece (140) having an upper surface and a side surface, the adaptor (A) comprising electrically conductive platings (121, 122, 123) each having a first portion arranged on said upper surface following a second layout and a second portion arranged on said side surface following said first layout, and in that the adaptor (A), together with its electrically conductive platings (121, 122, 123), is a separate element with respect to the electrically insulated base (1), together with its electrically conductive elements (11, 12, 13), at least part of said second portion of the electrically conductive platings (121, 122, 123) being configured and arranged to be connected to the electrically conductive elements (11, 12, 13) of the electrically insulating base (1) when the adaptor (A) is attached to the electrically conductive insulating base (1).

15. The adaptor of claim 13, wherein the adaptor (A) is configured for being attached to an antenna device with an electrically insulating base (1) which has an upper surface and a lower surface, wherein said lower surface comprises electrically conductive platings (110, 120, 130) following a third layout and which are electrically connected or integral to said electrically conductive elements (11, 12, 13) of the electrically insulating base (1) , wherein the second layout of the electrically conductive platings (121, 122, 123) of the electrically insulating piece (140) of the adaptor (A) is different to said first layout of the electrically conductive elements (11, 12, 13) of the electrically insulating base (1).

* * * * *